United States Patent [19]

Carlson

[11] Patent Number: 4,511,055

[45] Date of Patent: Apr. 16, 1985

[54] REMOVABLE PROTECTIVE SKIRT FOR A TANK

[76] Inventor: Franklin J. Carlson, 1081 Wisconsin Ave., Okauchee, Wis. 53069

[21] Appl. No.: 456,625

[22] Filed: Jan. 10, 1983

[51] Int. Cl.[3] ..... F17C 13/08

[52] U.S. Cl. ..... 220/69; 220/5 R; 220/85 K

[58] Field of Search ..... 220/69, 5 R, 94 R, 70, 220/85 K, 85 P, DIG.1

[56] References Cited

U.S. PATENT DOCUMENTS 3,158,296 11/1964 Cornelius ..... 220/5 R
3,355,049 11/1967 Nolan et al. ..... 220/5 R
4,372,458 2/1983 Carlson ..... 220/5 R X

FOREIGN PATENT DOCUMENTS 2031573 4/1980 United Kingdom ..... 220/85 K

*Primary Examiner*—Steven M. Pollard
*Attorney, Agent, or Firm*—Andrus, Sceales, Starke & Sawall

[57] ABSTRACT

A steel tank construction having a resilient protective skirt. The tank has a dome-shaped end head and a plurality of threaded studs are arranged in a generally circular pattern and extend outwardly from the head. A metal ring is provided with a plurality of outwardly extending projecting areas and each area is provided with an opening that receives one of said studs. An annular rubber-like protective skirt is vulcanized to the outer surface of the ring. Nuts are threaded on the outer ends of the studs to removably secure the ring to the tank head. The construction of the invention enables the protective skirt to be applied to the steel tank without welding and after annealing. As the ring and protective skirt are removably connected to the tank head, the ring can be removed in the field for replacement of the skirt if it becomes worn or damaged.

3 Claims, 4 Drawing Figures

FIG.1
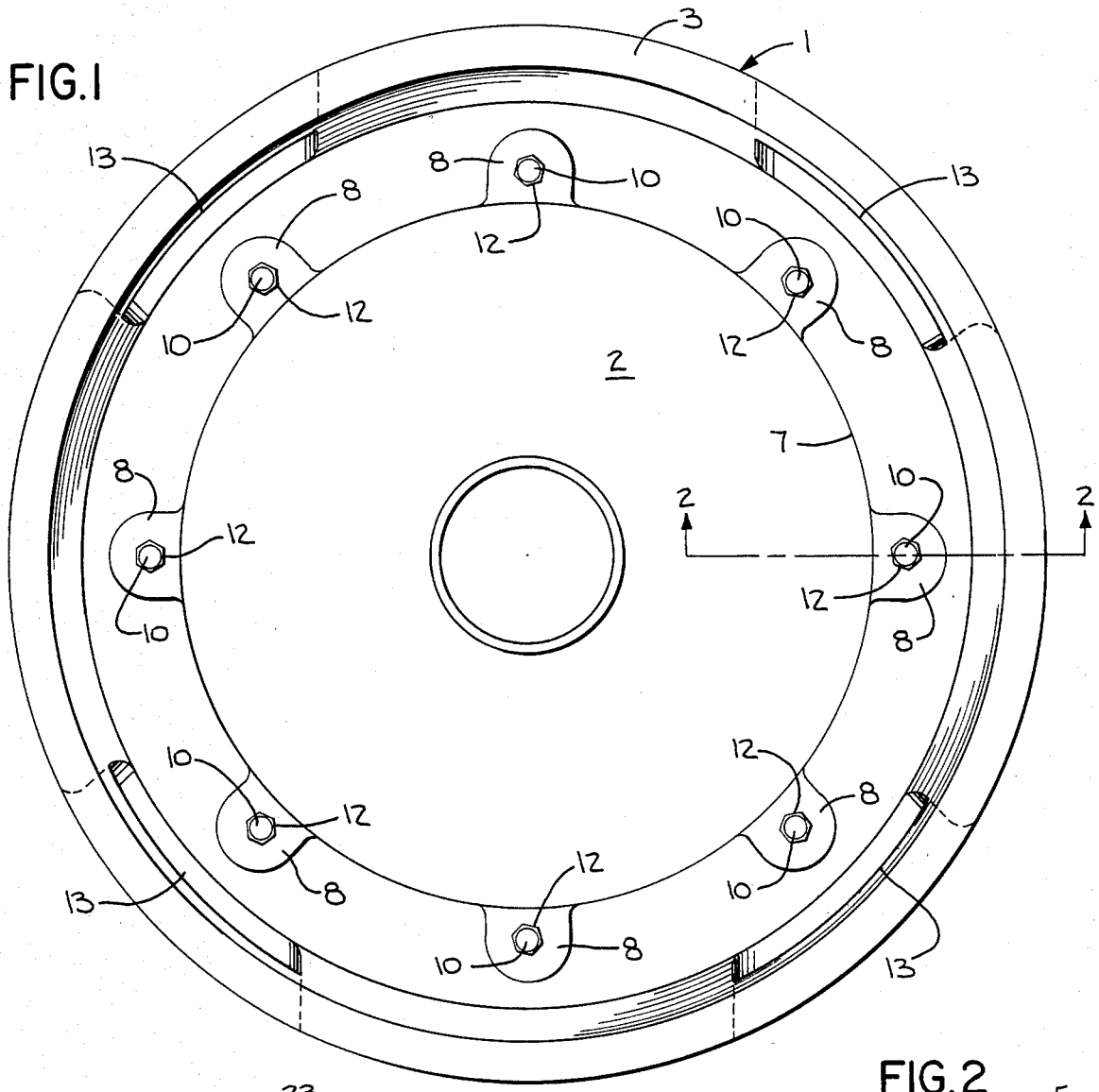
FIG.2
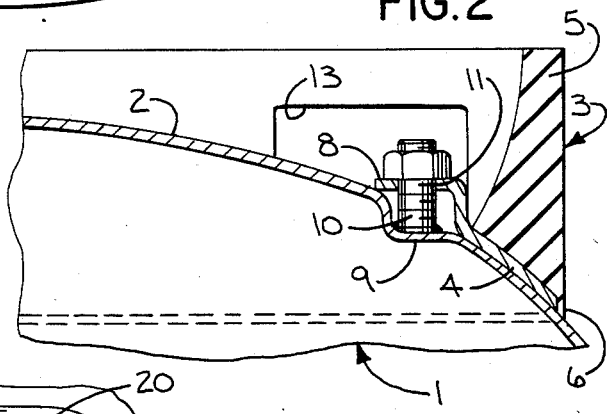
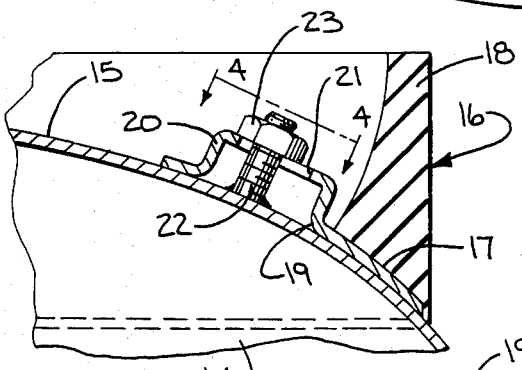
FIG.3
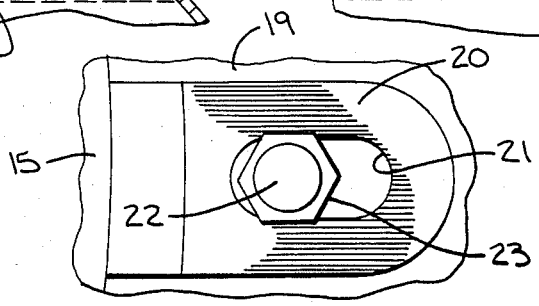
FIG.4

REMOVABLE PROTECTIVE SKIRT FOR A TANK

BACKGROUND OF THE INVENTION

Rubber or resilient skirts are frequently mounted on the heads of tanks, such as beer barrels or propane tanks, to protect the tank from impact, as well as providing an anti-skid, anti-spark supporting surface.

With large size tanks it is difficult to vulcanize the rubber skirt directly to the tank head, so that it has been the practice in the past with aluminum tanks to vulcanize the rubber skirt to a metal ring and subsequently weld the ring to the tank head. However, with steel tanks this practice cannot be utilized because after welding it is necessary to anneal the steel tank, and as the annealing temperature is generally in the range of about 1400° F. to 1600° F., the rubber skirt would be destroyed at this temperature. In view of this, there has been a need for a construction for applying a rubber protective skirt to a steel tank.

SUMMARY OF THE INVENTION

The invention is directed to a steel tank construction having a rubber protective skirt attached to a head of the tank. In accordance with the invention, a plurality of threaded studs are welded to the dome-shaped head in a circular pattern and extend outwardly from the head. The rubber protective skirt is vulcanized to a metal ring and the inner peripheral edge of the ring is provided with a plurality of outwardly extending projecting areas or lands and each of the areas has an opening to receive one of the studs. Nuts engage the outer ends of the studs to securely mount the ring and protective skirt to the tank head.

In one form of the invention, the tank head is provided with a plurality of flats, each of which lies in a plane normal to the axis of the tank, and the bases of the studs are welded to the respective flats so that the studs extend axially of the tank.

In a second form of the invention, the studs are welded to the outer surface of the tank and extend perpendicular to the dome-shaped head. In this embodiment, the projecting areas of the ring are provided with radially extending slots which receive the studs as the ring is applied to the tank head.

The protective rubber skirt serves to protect the tank against impact during shipment and handling, as well as protecting the underlying surface from marring and scratching if the tank is moved or pushed along the surface. Furthermore, the protective ring prevents skidding of the tank along the supporting surface which could occur during shipment, and prevents sparking which is an advantage if the tank is to contain flammable or explosive materials.

The protective skirt of the invention can be installed with the steel tank without welding and after annealing of the tank. In addition, the ring and rubber skirt can be removed from the tank in the field and replaced, if the skirt becomes damaged or worn. This is a distinct advantage over tank constructions in which the ring which supports the resilient skirt is welded to the tank head.

Other objects and advantages will appear in the course of the following description.

DESCRIPTION OF THE DRAWINGS

The drawings illustrate the best mode presently contemplated of carrying out the invention.

In the drawings:

FIG. 1 is a top plan view of a tank having a resilient protective skirt of the invention;

FIG. 2 is a section taken along line 2—2 of FIG. 1;

FIG. 3 is a view similar to FIG. 2 showing a modified form of the invention;

FIG. 4 is a section taken along line 4—4 of FIG. 3.

DESCRIPTION OF THE ILLUSTRATED EMBODIMENT

FIGS. 1 and 2 illustrate a steel tank 1, such as a propane tank, having a dome-shaped head 2, and a resilient skirt assembly 3 is attached to the head 2.

Skirt assembly 3 comprises a metal ring 4 which is disposed in contact with head 2 of tank 1, and an outwardly extending annular rubber skirt 5 which is vulcanized, or otherwise bonded to ring 4. As shown in FIG. 2, the outer peripheral edge 6 of skirt 5 projects axially inward beyond the corresponding edge of ring 4 and engages the head 2 of the tank.

The inner peripheral edge 7 of ring 4 extends radially inward beyond the periphery of the skirt 5 and is provided with a plurality of generally flat lands 8 each of which is disposed in a plane normal to the axis of the tank.

As shown in FIG. 2, the dome-shaped head 2 of tank 1 is correspondingly formed with a plurality of flats 9 which are aligned with the lands 8 of ring 4. The base of a threaded stud 10 is welded to each flat 9 and the studs extend outwardly through holes 11 in the lands 8. To secure the skirt assembly 3 to head 2, nuts 12 are engaged with the outer ends of the threaded studs 10.

To enable the tank to be readily lifted and handled, the skirt 5 is provided with a plurality of hand holes 13.

With the construction shown in FIGS. 1 and 2, the skirt 5 is initially vulcanized to ring 4. The ring 4 is then installed on head 2 with the studs 10, which had previously been welded to head 2, being received within holes 11. Nuts 12 are then installed to complete the assembly.

FIGS. 3 and 4 illustrate a modified form of the invention. In this construction, a steel tank 14, similar to tank 1, is provided with a dome-shaped head 15, and a protective skirt assembly 16 is secured to the outer surface of head 15.

Skirt assembly 16 includes a metal ring 17 and an outer protective rubber skirt 18, similar in construction to skirt 5.

As best illustrated in FIG. 3, the inner periphery 19 of ring 17 projects radially beyond the inner periphery of skirt 18 and is provided with a plurality of outwardly extending projecting areas or domes 20. Each dome 20 is provided with an elongated radially extending slot 21 which receives a threaded stud 22 welded to the outer surface of head 15. As illustrated in FIG. 3, the studs are disposed generally normal to the head 15. As in the case of the first embodiment, the skirt assembly 16 is secured to the head 15 by nuts 23 which are engaged with the outer ends of threaded studs 22.

As the nuts 23 do not extend axially of the tank, but instead are perpendicular to the domed head 15, the radially extending slots 21 enable the ring to be installed over the studs 22.

The tank construction of the invention enables the protective skirt assembly to be installed with a steel tank after annealing of the tank and without further welding.

As an additional advantage, the construction is removable and can be removed from the tank by merely disengaging the nuts and a new protective skirt assembly installed.

Various modes of carrying out the invention are contemplated as being within the scope of the following claims particularly pointing out and distinctly claiming the subject matter which is regarded as the invention.

I claim:

1. A tank assembly, comprising a steel tank having a dome-shaped head, a plurality of threaded studs extending outwardly from the head and arranged in a generally circular pattern, a metal ring having a plurality of outwardly extending projecting areas with each area having an opening to receive one of said studs, an annular resilient skirt bonded to the outer surface of said ring, and a plurality of nuts each engaged with one of said studs to secure said ring and said skirt to said head said head being provided with a plurality of flats aligned with said areas, each flat being disposed in a plane perpendicular to the axis of said tank, each of said studs being secured to a flat and extending axially of said tank.

2. The assembly of claim 1, wherein said areas are lands disposed generally parallel to the respective flats and spaced from said flats.

3. A tank assembly, comprising a steel tank having a dome-shaped head, said head including a plurality of flats disposed in a generally circular pattern with said flats being disposed in a common plane normal to the axis of said tank, a threaded stud secured to each flat and extending axially of said tank, a protective skirt assembly connected to said head and including an inner metal ring and an outer annular resilient skirt bonded to the outer surface of said ring, said ring having a plurality of lands disposed in axial alignment with said flats and spaced from said flats, the corresponding flats and lands being disposed generally parallel to each other, each land having an opening to receive the respective stud, and a connecting member threaded onto the outer end of each stud to secure said skirt assembly to said head.

* * * * *